United States Patent [19]

Thackray

[11] 4,085,331

[45] Apr. 18, 1978

[54] SOURCES OF NUCLEAR RADIATION

[75] Inventor: Malcolm Thackray, Sutherland, Australia

[73] Assignee: Australian Atomic Energy Commission, Coogee, Australia

[21] Appl. No.: 727,118

[22] Filed: Sep. 27, 1976

[30] Foreign Application Priority Data

Oct. 30, 1975 Australia ..... 3781/75

[51] Int. Cl.[2] ..... G21G 4/04

[52] U.S. Cl. ..... 250/493; 96/58

[58] Field of Search ..... 250/493; 96/58

[56] References Cited

U.S. PATENT DOCUMENTS 2,603,755 7/1952 De Ment ..... 250/493

2,699,994 1/1955 Umberger ..... 96/58

3,329,817 7/1967 Walz ..... 250/493

*Primary Examiner*—Archie R. Borchelt

*Attorney, Agent, or Firm*—Ladas, Parry, Von Gehr, Goldsmith & Deschamps

[57] ABSTRACT

A uniform source of nuclear radiation is produced by converting a convertible surface portion of a body. The conversion can be by chemical combination or reaction, neutron bombardment, ion exchange of an element present in the convertible material with a solution of radio-active ions of the element or by permitting the radio active particles to be embodied into the surface portion. A preferred embodiment utilises conventional photographic film in which the silver halide grains are treated chemically with a radio-active material.

14 Claims, 1 Drawing Figure

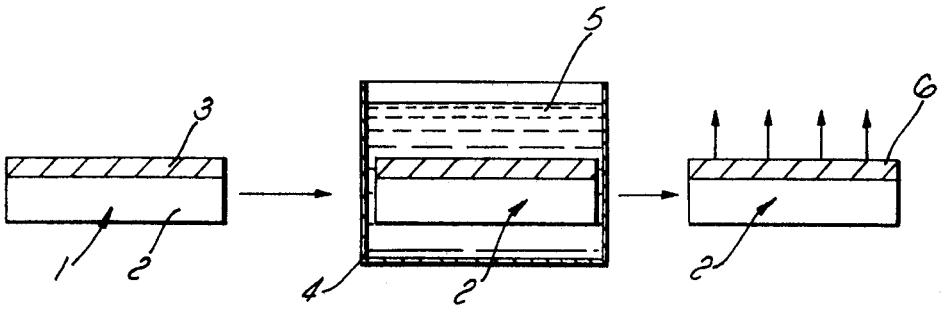
3
1
2
5
4
2
6
2

SOURCES OF NUCLEAR RADIATION

The present invention relates to sources of nuclear radiation which includes alpha, beta, gamma and X-radiation as well as fission fragments and neutrons. More particularly the present invention is concerned with the problem of providing a substantially uniform source of nuclear radiation extending over a surface.

Substantially uniform sources of nuclear radiation are required in many fields, one of which concerns low power sources having no elaborate shielding and which can be readily used in industry and commerce for many purposes. One purpose is the examination of paper structure and water marks in paper. The source is placed in contact with the paper to be examined and an image is prepared on a sheet of film such as X-ray film in contact with the other side of the paper. This technique can reveal considerable information about the characteristics of paper sheets and other objects such as thin biological structures, for example membranes and leaves.

Hitherto, sources of uniform radiation in the form of flat sheets have been used, the flat sheets being of plastic material such as perspex in which the radio-isotope carbon-14 is used. These sheets are manufactured by a polymerisation process which is relatively expensive in view of the careful control necessary to achieve a uniform product and the safety precautions needed for handling the radioactive material. Liquid monomer in the form of methacrylate is uniformly labelled with carbon-14 and polymerisation is effected with the carbon-14 uniformly dispersed. The radiation field is very uniform since the radiation is short range beta radiation having an end point energy of 0.156 MeV. Conveniently the sheets are a few millimeters thick to provide the necessary mechanical strength and may be 20 cm. square in area. A sheet of this thickness is said to have "infinite thickness" because the thickness exceeds the range of the radiation in the material and it is effectively only the carbon-14 near the surface of the sheet which provides radiation into the adjacent air space. Sheets of this type referred to are very expensive, typically about $800.00 and this capital cost is a severe problem to libraries and other institutions which could well have the need for several such sources of radiation.

Another limitation is that it is not easy to extend the fabrication technique referred to above to the use of other isotopes for the purpose of varying the range of the beta radiation or other types of nuclear radiation that may be used.

Another known uniform source of nuclear radiation is that prepared by electroplating the isotope onto a substrate, but it has been found that only a few isotoes are capable of use in this method. Furthermore, it is difficult to achieve uniformity over large areas, and from a uniformity, durability and safety point of view, there is the severe disadvantage in that the surface is easily abraded and radioactive particles may be removed It would, therefore, be a great advance to provide substantially uniform sources of nuclear radiation by a method which can be used with a range of different isotopes or other materials which can be activated to become sources of nuclear radiation, the method being economic, susceptible to variations and capable of producing a product which does not present significant contamination risks.

Broadly speaking, the present invention is directed, in one aspect, to a product which acts as a substantially uniform source of nuclear radiation extending over an area of a body, the body having a surface portion of material which has been converted to become a source of nuclear radiation by treatment with a source of nuclear radiation.

Broadly speaking, in a second aspect of the invention, there is provided a method of forming a substantially uniform source of nuclear radiation comprising taking a body having a surface portion extending over an area and being of a material which is capable of conversion to become a source of nuclear radiation, and treating said surface portion of covertible material by the use of a source of nuclear radiation such that the surface portion becomes a substantially uniform radioactive source.

The surface portion may be convertible by a variety of methods including chemical reaction by combination or substitution, ion exchange, neutron bombardment and embedding radioactive particles.

One important process for effecting the conversion is by the use of a material which acts as a toner to combine chemically or react chemically with the convertible material, the toner including radioactive material.

The invention also consists in a treatment process in which a substantially uniform source of nuclear radiation formed by the method described above or being according to the product described above is applied to a structure which is to be treated whereby the structure is treated and a useful result is obtained as a result of the nuclear radiation falling substantially uniformly thereon.

Although chemical toning is a preferred process of forming the source, other techniques are possible. For example, the convertible material may be such that when bombarded with radiation such as neutrons, the material converts to become a source of nuclear radiation.

In another method, the convertible material is selected with initial properties or is chemically treated so as to acquire properties such that it becomes radioactive by ion exchange with a solution of radioactive ions of an element present in the convertible material.

The present invention is based on the appreciation that a very useful product and process can follow from appropriate treatment of a convertible surface portion of a body; the surface portion does not need to be a separate and different material from the remainder of the body and the invention includes treating a homogeneous material in which a surface region thereof is treated.

As will be explained hereinafter in more detail, the invention may be embodied in many different ways relatively cheaply and conveniently so that a wide range of applications can be catered for without stringent and inconvenient health physics requirements being used.

Conveniently the body is a solid material which is formed with a suitable surface layer or surface portion and this can be either a specially made product or one which is selected from currently commercially available sources. Since no radioactive material is employed in this manufacture, costs can be kept down. The selected treatment with the sources of nuclear radiation can then be implemented in an appropriate laboratory for processing radioactive material. It is a simple matter to design a suitable shielded tank in which chemical toning can take place. In many instances the product can then emerge with a very low level of radiation at low energies at short range so that shielding may not even be necessary. Indeed when the invention is applied to the use of, for example, a self-illuminating panel, the panel will emit visible light safely but harmful radiation may be absorbed in a few centimeters of air.

An important application of the invention is to treat chemically a photographic film or plate so that the film or plate emulsion becomes a uniform source of nuclear radiation. A photographic film or plate is a readily available economic source of a convenient starting material which can be treated according to the invention.

Many publications have dealt with the radioactive toning of photographs and attention is specifically directed to U.S. Pat. No. 2,603,755 and an extensiver survey of this field of toning photographs reported by the present inventor in a publication entitled "Autoradiography of Radioactive Photographic Images — Applications to Intensification, Restoration, Precision Etching, Photomechanical Reproduction and Photographic Research", published by Australian Atomic Energy Commission under Reference AAEC/E317 and accorded National Library of Australia card number and ISBN 0 642 99656 3. Although it has been previously well known that radioactive toning and photographs can occur and this can be useful in enhancing the image in, for example, a grossly underexposed photograph, the applicants know of no prior suggestion in the field of uniform sources of nuclear radiation that techniques from the unrelated field of photography may be used.

An important embodiment of the invention consists in applying to a starting material comprising a silver halide emulsion on a substrate, a toning material including a material which either is itself a source of nuclear radiation or after its application to the silver halide emulsion can be bombarded with neutrons to become a source of nuclear radiation.

Although in one application of this embodiment the silver halide emulsion is in an unprocessed state when the material is applied to effect the toning operation, the uniformity of the product can be no better than the uniformity of the commercial emulsion and there may be tolerances of a few percent. However, greater uniformity can be achieved if the emulsion is first exposed to electromagnetic radiation uniformly followed by normal photographic processing whereby the retained silver halide grains are uniformly distributed over the substrate.

The invention can be applied to flexible arrangements in which the substrate is a gelatin layer and thus can be bent to conform to a desired configuration, or a rigid substrate such as glass plate could be used.

In one embodiment of the invention the silver halide in the emulsion or the developed silver in the emulsion is made radioactive by the application of a toning solution in which exchange occurs between the silver halide or developed silver of the emulsion with a radioactive silver or halide ion of the toning solution.

Another embodiment of the invention consists in toning the silver halide emulsion or developed silver of the emulsion with a non-radioactive material and then subsequently exchanging atoms or ions for radioactive atoms or ions in solution.

The silver halide emulsion may be dispersed in a permeable support material such as gelatin, polyvinyl alcohol or other suitable material.

In view of this disclosure, many applications of the invention will readily be appreciated. For example, a uniform source of nuclear radiation may be used to make an adjacent surface etchable. For example, plastics, glass or other material may be treated so that by subsequent chemical processing, the surface that has been subjected to radiation from the source is readily etched. Templates may be used in conjunction with the uniform source so that shapes and information can be provided on the medium which receives the radiation. This configuration could be applied to radiation treatment of diseased skin, branding of animals, the production of electrical printed circuits and artistic treatment of surfaces with desired patterns.

Another use of the invention is as a source of radiation which is to impinge on material which emits electromagnetic radiation when receiving the radiation from the source. Self-illuminating signs can be readily be fabricated using this arrangement and these can have wide application for example in theatres.

The invention can also be used in the analysis of materials in which the source of nuclear radiation is positioned suitably adjacent a material which is to be analysed. The nuclear radiation falls on the material to by analysed and characteristic radiation is emitted from this material. For example, spectrometry can be effected utilising the emitted X-rays and gammarays to permit surface analysis to be formed.

For the purpose of illustrating the invention only specific examples will be given, but it is to be understood that the invention may readily be applied in many other ways.

EXAMPLE I

In this example a uniform source of beta radiation is provided utilising a photographic film as a starting material and toning with a material including sulphur-35. The method comprises the following steps:

1. An unexposed piece of photographic film comprising preferably a fine grain negative emulsion on a plastic sheet base is first washed with a 2% solution of potassium carbonate to swell rapidly the gelatin and to remove dyes and other unwanted material which normally would be removed in a development step. The film is cleaned by running water. Preferably, the process is conducted in subdued light but darkroom conditions are not essential.

2. The film is transferred to a solution of 1% sodium sulphide labelled with the isotope sulphur-35. The solution should have 5 mg. of sulphur for every $cm^2$ of film although if double-coated X-ray film is used then the quantity of sulphur is doubled. Agitation or stirring is desirable to ensure that all parts of the film are contacted by the liquid and it will be observed that the cream-coloured silver halide emulsion slowly turns brown as radioactive silver sulphide is formed. This toning operation takes about an hour.

It is pointed out that the higher the specific activity of the sodium sulphide, the greater will be the radioactivity fixed in the film. However, carrier-free i.e. isotopically pure sulphur-35 in the form of sodium sulphide should not be employed. Sulphur with a specific activity in the range of 0.1 to 1.0 ci/g is adequate for many purposes.

3. Next, the film is rapidly transferred to a 2% solution of sodium sulphite and agitated for half an hour for the purpose of dissolving the remaining sodium sulphide which if left on the film would oxidize in air to leave non-uniform and unwanted deposits.

4. Rapid rinsing is then effected in demineralised water before the film is hardened for 20 minutes in a 5% solution of formalin.

5. 30 minutes washing in running water then occurs before the film is allowed to dry.

It is pointed out that in this example the uniformity of the source depends on the existance of a uniform coating of silver halide on the original film. It appears that fairly uniform silver halide distribution occurs in commercially available film but if greater uniformity is required, then one of the arrangements illustrated in the following examples should be utilised.

EXAMPLE 2

In this example a uniform source of X-radiation is provided using a photographic film toned by material including iron-55. The procedure is as follows:

1. A piece of photographic film having a silver halide emulsion is taken and subjected to uniform irradiation by visible light, conveniently from an electric lamp in a translucent envelope positioned several meters directly in front of the emulsion of the film. The length of exposure and illumination intensity are selected such that the film when developed and fixed in the normal manner, has a density in the range of 0.5 to 2.0. Since there has been the uniform exposure to visible light, the normal photographic developing and fixing process will result in a virtually uniform distribution of the exposed, developed and fixed silver grains in the product irrespective of whether the original film was completely uniform.

2. Bleaching of the photograph is effected by 30 minutes in a 5% solution of potassium ferricyanide or for a length of time sufficient to effect complete bleaching. The silver grains are converted to silver ferrocyanide.

3. Thorough washing is effected by two separate periods of ten minutes washing with demineralised water which is filtered to be free of all rough particles which can have an adverse effect.

4. Hardening is effected for 20 minutes in a 5% formalin solution.

5. Further washing is effected for 20 minutes in running water.

6. A solution of ferric chloride labelled with iron-55, and in which the pH has been adjusted to 2.0 by the use of nitric acid is then applied to the film for the purpose of effecting the toning operation. About 2 mg of iron is necessary for each square centimeter of film and the specific activity of the iron-55 should be several curies per gram. The toning operation takes several hours during which agitation or stirring is effected. The process is complete when a uniform blue colour occurs in the photograph.

7. 10 minutes washing with dilute nitric acid at pH2 follows before 10 minutes washing with demineralised water. Finally, 20 minutes washing with running water is necessary before drying occurs.

EXAMPLE 3

In this example a uniform source of alpha radiation, fission fragments and neutrons is provided using a photographic film and a toning material including californium-$^{252}$.

The process is the same as in Example 2 except that californium chloride is substituted for ferric chloride, californium-$^{252}$ being the labelling material. The quantity of californium should be in the range 1$\mu$Ci - 1 mCi per cm$^2$ of film depending on the strength of source desired.

Further possible methods embodying the invention are suggested below.

EXAMPLE 4

It is suggested that by immersing a sheet of high quality glass in a solution containing the isotope cesium-137 in dilute hydrochloric acid for several days, ions of the cesium isotope slowly penetrate into the glass surface in a uniform manner.

The rate of penetration is adjusted by controlling the temperature and the concentration of the isotope in solution and simply by removing the sheet from the solution from time to time, the up-take of cesium-137 can be monitored with a suitable radiation counter.

When the desired strength has been reached in the source, it is removed from solution, washed for about 10 minutes with dilute nitric acid before a final washing is effected in water.

From the health physics point of view an improvement can be made if the resistance to abrasion is improved by heating the glass for several hours in a furnace to a temperature about 100° C below the softening point of the glass.

The above example may also be useful with other radioactive ions which are capable of penetrating the silicate structure of glass.

Embodiments of the present invention may be used with great advantage to treat uniformly various materials. For example, the surface of a structure can be subjected to radiation damage by placing an extended source of nuclear radiation adjacent the surface. The radiation damage resulting may be very useful for many purposes such as rendering the surface etchable, wettable by printing inks, sterile, more responsive to adhesives, paints and surface coatings, or to be more chemically reactive. Furthermore, micropore filters may be formed by radiation damage applied to a thin membrane from a radiation source embodying the present invention.

However, a major use for which the invention has been conceived is observing the microstructure of this material such as paper sheets, using a radiography technique.

Another application, is the combination of self-illuminating surface having phosphor material applied thereto and disposed adjacent a source according to the invention, whereby the radiation from the source impinges on the phosphor material thereby inducing emission of light.

Sources according to the invention may also be used in a method of spectrometry comprising disposing a material to be subjected to spectrometry adjacent the source whereby characteristic X-rays or gamma-rays are emitted as a reaction to the incident radiation from the source. The emitted X-rays or gamma-rays are then analysed.

Another application is an arrangement for monitoring change in ambient conditions. This application will be exemplified by apparatus for measuring atmospheric humidity in which gelatin or similar material which is sensitive and responsive to humidity is located relative to the source of nuclear radiation and a receiver such that, due to volume and density changes of the gelatin with the humidity change the nuclear radiation received varies.

By the use of templates, the nuclear radiation from a source according to the invention can cause a surface to be made non-uniformly radioactive whereby information can be stored. For example, livestock may be "branded" by holding the source in position for a suitable time.

Particularly for some uses, it can be highly desirable to apply a surface coating of thin layer or to surface harden the surface of the source to make it more resistant to abrasion, heat and solvents. For example, such protection can be readily applied to the case when the radioactive material is dispersed in an emulsion of gelatin.

Set out below is a table of suitable isotopes for uniform sources embodying the present invention:

| Isotope | Radiation | Max.Energy | Half-Life | |
|---|---|---|---|---|
| Nickel-63 | Beta | 0.062 MeV | 85 | years |
| Sulfur-35 | Beta | 0.167 MeV | 87 | days |
| Promethium-147 | Beta | 0.223 MeV | 2.6 | years |
| Iron-55 | (e) x-ray | 0.006 MeV | 2.9 | years |
| Polonium-210 | Alpha | 5.3 MeV | 138 | days |
| Californium-252 | Fission fragments, Neutrons, Alpha | Fission ~ 200 MeV Alpha 6.1 MeV | 2.65 | years |

One embodiment of the invention is illustrated in the accompanying drawings which illustrate the processing of a photographic film which has been exposed to a uniform gray level.

The film 1 comprises a flexible film substrate 2 and emulsion coating 3 which in this case has been uniformally exposed to a gray level and developed and fixed. The film is passed to a tank 4 which contains a liquid processing medium which turns the gray developed emulsion to become a uniform source of nuclear radiation. The product is obtained after washing and drying to result in a substrate 2 having a surface layer 6 which is a substantially uniform source of nuclear radiation. This source is flexible but if in a flat position, the source is a uniform plane source.

I claim:

1. A method of forming a substantially uniform source of nuclear radiation comprising taking a body having a surface portion extending over an area and including an approximately uniform dispersion over the area of a material characterized by the property of being convertible to become a substantially uniform source of nuclear radiation, and substantially uniformly treating said surface portion with nuclear radiation to convert a substantially uniformly dispersed proportion of said material and to leave the converted material firmly bound to said body, whereby said surface portion becomes a substantially uniform source of nuclear radiation.

2. A method as claimed in claim 1, wherein said treatment step is effected by applying a radioactive chemical toning material to said surface portion.

3. A method as claimed in claim 1, wherein said treatment step comprises exposing said surface portion to a substantially uniform neutron bombardment.

4. A method as claimed in claim 1, wherein said treatment step comprises treating said surface portion chemically to become responsive to neutron bombardment, and subjecting said surface portion to a substantially uniform neutron bombardment.

5. A method as claimed in claim 1, wherein said treatment step comprises applying a solution of radioactive ions of an element present in said convertible surface portion and effecting ion exchange.

6. A method of forming a substantially uniform source of nuclear radiation comprising taking a body comprising a substrate and a photographic layer in the form of a halide emulsion, exposing said photographic layer to a highly uniform source of electromagnetic radiation to which it is sensitive, developing the emulsion layer by a photographic processing method which results in fixing to the substrate the exposed halide grains which are uniformly distributed over the substrate and removing the unexposed halide grains, and treating the layer of exposed halide grains uniformly with a field of nuclear radiation whereby a substantially uniform source of nuclear radiation is provided by said exposed halide grains.

7. A method as claimed in claim 6, wherein said treatment step is selected from the group consisting of neutron bombardment, chemical toning with a radioactive chemical, and ion exchange of a solution of radioactive ion of an element present in said surface portion.

8. A method as claimed in claim 6, wherein said field of nuclear radiation is provided by a material selected from the group consisting of Nickel-63, Sulphur-35, Promethium-147, Iron-55, Polonium-210 and Californium 252.

9. A method as claimed in claim 6, wherein said treatment comprises bleaching the developed and fixed emulsion with a solution of potassium ferricyanide, and applying a solution of ferric chloride labelled with iron-55 or a solution of californium chloride labelled with californium-252.

10. A method of forming a substantially uniform source of radiation comprising taking a substrate having an approximately uniform electromagnetic radiation sensitive photographic layer applied to a surface thereof, substantially uniformly treating said layer with nuclear radiation to convert a substantially uniformly dispersed proportion of said layer, and further treating said layer to remove the unconverted proportion of said layer to leave a highly uniform converted layer which is fixed to said substrate and which consists of a substantially uniform source of nuclear radiation.

11. A method as claimed in claim 10, wherein said treatment is effected by a sodium sulphide solution of the isotope Sulphur-35 to convert the silver halide to radio-active silver sulphide.

12. A method as claimed in claim 10, wherein the step of uniformly treating said layer is selected from the group consisting of neutron bombardment, chemical toning with a radioactive chemical, and ion exchange of a solution of radioactive ions of an element present in said layer.

13. A method of forming a substantially uniform source of alpha radiation, fission fragments and neutrons for nuclear etching of surfaces, comprising taking a piece of photographic film having a silver halide emulsion, exposing said emulsion to uniform irradiation by visible light, developing and fixing the film to provide a virtually uniform distribution of the exposed, developed and fixed silver grains, and uniformly treating said uniform distribution of silver grains with a solution of californium chloride labelled with californium -252 to convert the distributed silver grains to become said substantially uniform source.

14. A product which acts as a substantially uniform source of nuclear radiation extending over an area of a body, the body having a surface portion of material which has been converted to become a source of nuclear radiation by treatment with a source of nuclear radiation.

* * * * *

Disclaimer 4,085,331.—*Malcolm Thackray*, Sutherland, Australia. SOURCES OF NUCLEAR RADIATION. Patent dated Apr. 18, 1978. Disclaimer filed July 13, 1979, by the assignee, *Australian Atomic Energy Commission.*

Hereby enters this disclaimer to claims 1 to 5 and 14 of said patent.

[*Official Gazette September 4, 1979.*]